United States Patent [19]

Hosowari et al.

[11] Patent Number: 5,042,446

[45] Date of Patent: Aug. 27, 1991

[54] ENGINE CONTROL SYSTEM

[75] Inventors: Shigenori Hosowari, Katsuta; Takashi Shiraishi, Ibaraki, both of Japan

[73] Assignees: Hitachi, Ltd., Tokyo; Hitachi Automotive Engineering Co., Ibaraki, both of Japan

[21] Appl. No.: 429,545

[22] Filed: Oct. 31, 1989

[30] Foreign Application Priority Data

Nov. 9, 1988 [JP] Japan ..... 63-281244

[51] Int. Cl.[5] ..... F02M 37/04

[52] U.S. Cl. ..... 123/452; 123/422

[58] Field of Search ..... 123/452, 453, 454, 455, 123/457, 458

[56] References Cited

U.S. PATENT DOCUMENTS

| | | | |
|---|---|---|---|
| 3,974,811 | 8/1976 | Stumpp | 123/453 |
| 4,341,192 | 7/1982 | Knapp | 123/452 |
| 4,501,247 | 2/1985 | Gassler | 123/453 |
| 4,520,783 | 6/1985 | Matsushita | 123/422 |
| 4,640,251 | 2/1987 | Harada | 123/422 |
| 4,682,577 | 7/1987 | Kato | 123/422 |
| 4,745,903 | 5/1988 | Gmelin | 123/452 |

FOREIGN PATENT DOCUMENTS 55-46096 3/1980 Japan .

*Primary Examiner*—Carl S. Miller

*Attorney, Agent, or Firm*—Antonelli, Terry, Stout & Kraus

[57] ABSTRACT

An engine control system comprises a fuel injection valve, a plate disposed in an air intake passage so as to move according to the intake air flow rate, a fuel distributor including the above-mentioned plate and mechanically controlling fuel flow rate to the fuel injection valve on the basis of the movement of the plate, and an actuator connected to the fuel distributor for increasing or decreasing fuel flow rate to the fuel injection valve, and is characterized in that the engine control system comprises acceleration fuel increment means for incrementing fuel flow rate, to the fuel injection valve from the fuel distributor, necessary to accelerate the engine after detection of acceleration through a control of the actuator.

11 Claims, 7 Drawing Sheets

ENGINE CONTROL SYSTEM

BACKGROUND OF THE INVENTION

The present invention relates to an engine control system and, more particularly, to an engine control system suited for controlling acceleration of an engine having a mechanical fuel injection device.

A so-called mechanical fuel injection apparatus for mechanically controlling a fuel injection rate on the basis of motion of a plate disposed in an intake air passage is well known, as is disclosed in Japanese Patent Laid-Open No. 55-46096 (1980).

The prior art described above takes no consideration into operations during acceleration. Even if a throttle valve for control of intake air flow is opened for acceleration, a fuel injection rate, for example, is not promptly increased due to delay in response to a mechanical system so that the fuel is not augmented with the increase in the intake air flow. As a result, the air/fuel ratio is shifted to the lean side resulting in reduced torque, but this torque is then abruptly raised to produce acceleration shocks so that hunting occurs after the acceleration.

SUMMARY OF THE INVENTION

An object of the present invention is to provide an engine control system which has a mechanical fuel injection apparatus and which can reduce acceleration shocks and hunting due to acceleration and after the acceleration.

An engine control system having a mechanical fuel injection control apparatus comprises a fuel injection valve, a plate disposed in an air intake passage so as to move according to the intake air flow rate, a fuel distributor including the above-mentioned plate for mechanically controlling fuel flow rate to the fuel injection valve on the basis of the movement of the plate, and an actuator connected to the fuel distributor for increasing or decreasing fuel flow rate to the fuel injection valve. Briefly stated, the present invention is characterized in that the engine control system comprises an acceleration fuel increment system for incrementing fuel flow rate to the fuel injection valve from the fuel distributor, as necessary to accelerate the engine after detection of acceleration through control of the actuator.

In the engine control system of the present invention, the actuator is controlled, when the acceleration is detected, to increment the fuel supply rate from the fuel distributor to the injection valve. Thus, the engine is supplied with fuel at a proper rate even during acceleration so that torque reduction can be suppressed to prevent acceleration shocks and hunting.

DESCRIPTION OF THE INVENTION

Figure 1:
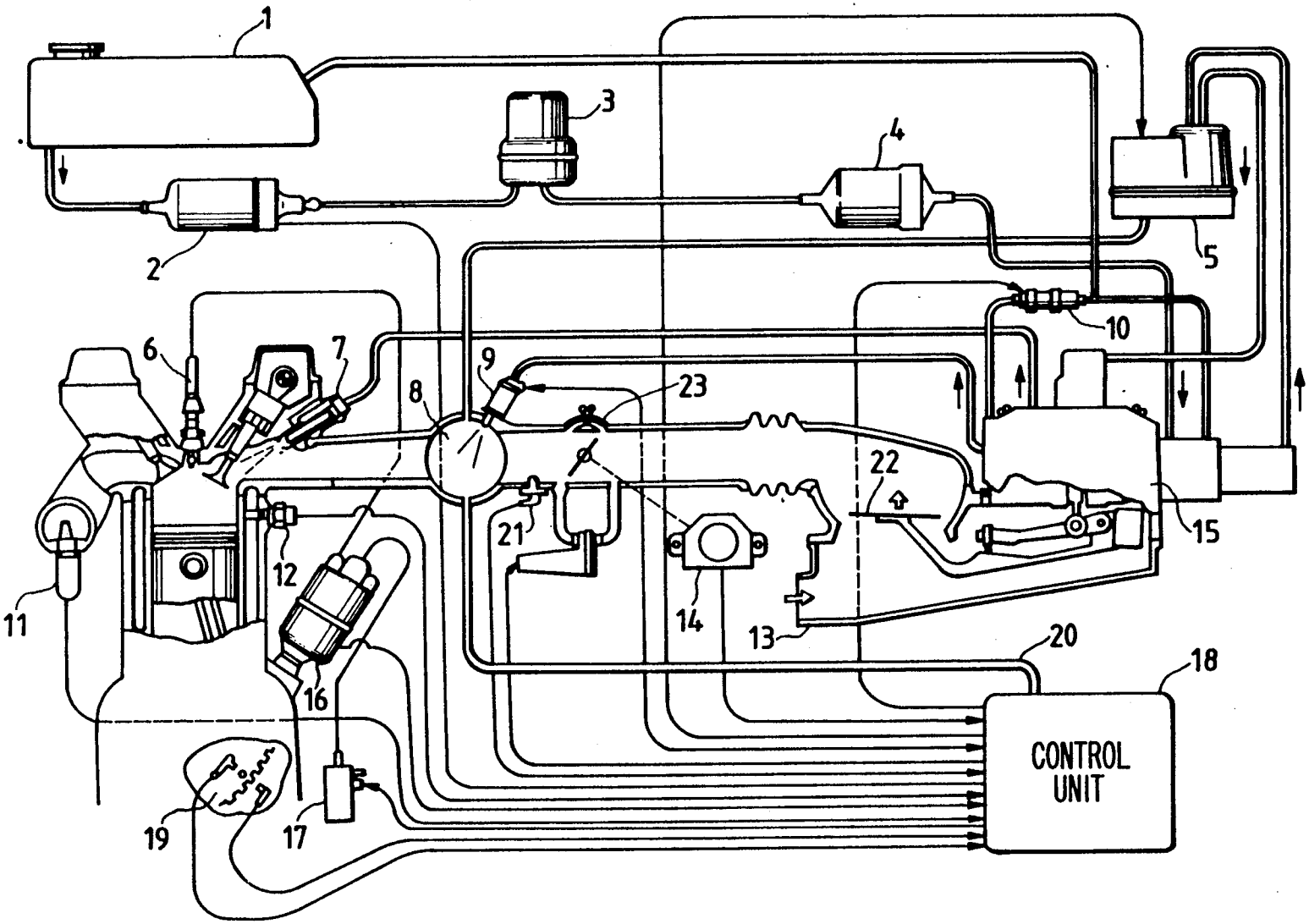
FIG. 1 is a diagram of a engine control system having a mechanical fuel injection control apparatus.

In FIG. 1 showing an engine control system, air is sucked from an intake port 13 of an intake passage into the cylinder of an engine by way of a throttle body 23 having a throttle valve and a surge tank 8. The opening degree of the throttle valve is detected by a throttle sensor 14, the detected signal of which is inputted to a control unit 18. In the vicinity of the throttle body, there is disposed an intake temperature sensor 21 for detecting the intake temperature to feed its detected signal to the control unit. On the other hand, fuel is sucked from a fuel tank 1 and compressed by a fuel pump 2 so that it is fed through fuel accumulator 3 and a fuel filter 4 to a fuel distributor 15. This fuel distributor mechanically controls the flow rates of the fuel to be fed to an injection valve 7 and a surge valve 9 through a warm-up regulator 5 on the basis of both an extent of movement of a plate 22 disposed in the intake passage near the air intake port 13 and an operated quantity of a solenoid actuator 10. The fuel thus supplied from the injection valve 7 and the surge valve 9 is mixed with the intake air so that the resultant mixture is sucked into the cylinder of the engine. The mixture thus sucked is subjected to compression and explosion strokes so that it is converted into a mechanical energy, which is transmitted to the crankshaft of the engine. The burned mixture is discharged to the atmosphere through an exhaust pipe. This exhaust pipe is equipped with an $O_2$ sensor 11, the detected signal of which is inputted to the control unit 18. The engine temperature is detected by a water temperature sensor 12 for detecting the engine water temperature so that the detected signal is inputted to the control unit 18. The crankshaft is equipped with a crank angle sensor 19 for generating a signal, when the crankshaft turns through a predetermined angle, to input it into the control unit 18. Moreover, the ignition signal from the control unit 18 is transmitted to the power transistor 17 of an ignition coil so that it is distributed by a distributor 16 to each of the engine cylinders to cause an ignition at an ignition plug 6.

Figure 2:
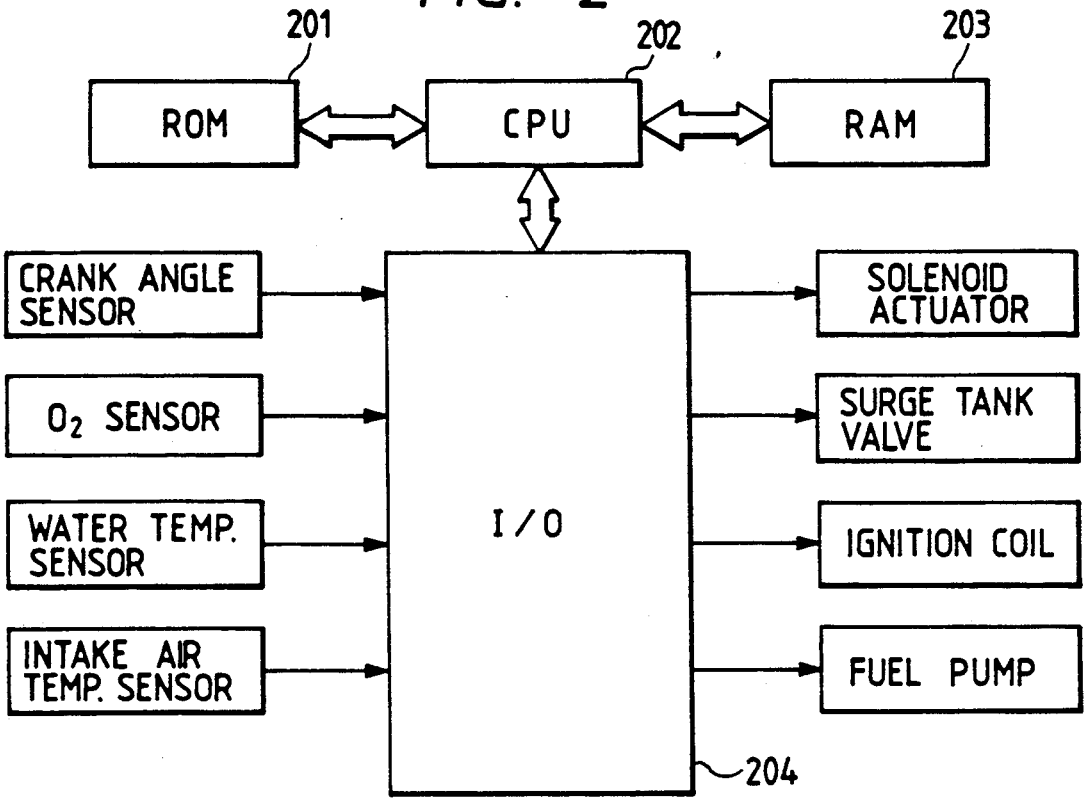
FIG. 2 is a diagram showing a control unit of FIG. 1.

FIG. 2 is a diagram showing the structure of the control unit 18. This control unit 18 is composed of a ROM 201, a CPU 202, a RAM 203 and an I/O 204. The individual sensor outputs are introduced through the I/O 204 into the CPU 202. The CPU 202 accomplishes its arithmetic operations on the basis of the programs and control data stored in the ROM 201. Incidentally, the temporary data for the arithmetic operations are latched in the RAM 203. In response to the processed signals from the CPU 202, the individual actuators are controlled through the I/O.

Figure 3:
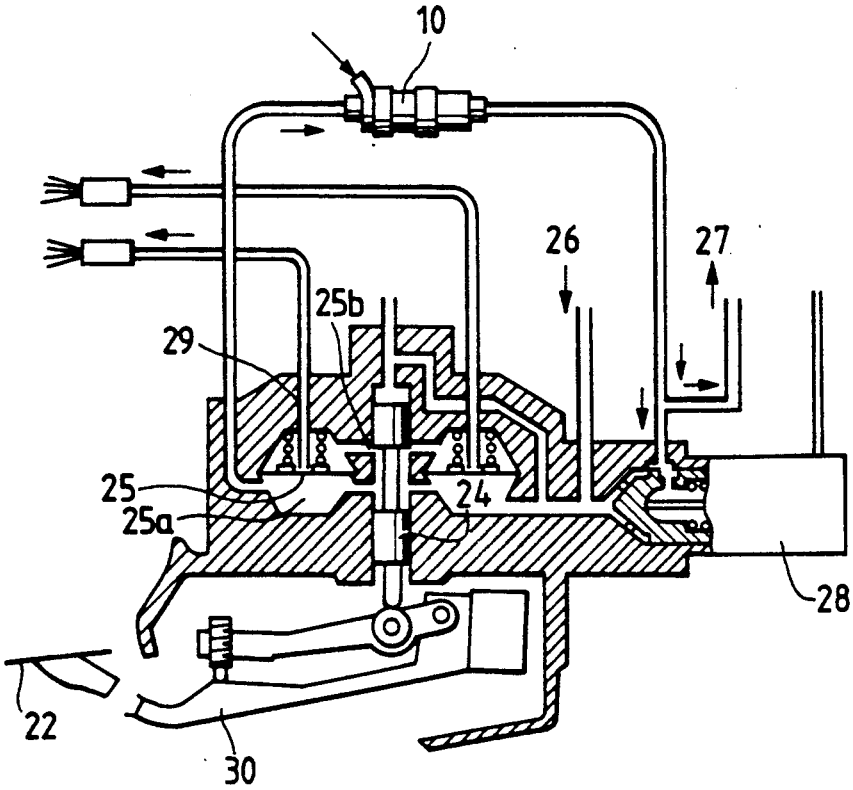
FIG. 3 is a sectional view of a fuel distributor employed in the engine control system of FIG. 1.

FIG. 3 is a sectional view showing the structure of the fuel distributor 15. The fuel is fed from the fuel pump 2 through a pipe 26 into a diaphragm chamber 25*a* having a diaphragm 25 therein. The flow rate of the fuel from the diaphragm chamber 25*a* to a pipe 29 leading to the injection valve 7 is controlled by a plunger 24 to be moved up and down by a support 30 to which is fixed the plate 22. Now, if the amount of the intake air is increased for acceleration, the plate 22 is moved up so that the plunger 24 increases the area of a passage 25*b* from the lower side of the diaphragm 25 to the upper side thereof to increase the fuel. When the plate 22 is moved down, the fuel through the pipe 29 is decreased.

On the other hand, the fuel through the diaphragm chamber 25*a* is partially returned through the actuator 10 via the pipe 27 to the fuel tank 1. Numeral 28 designates a regulator for regulating the pressure. If the actuator 10 is operated to increase the flow rate of the fuel flowing in the actuator 10, the diaphragm 25 is warped down by the dropped pressure at the lower side of the diaphragm 25 so that the fuel flow rate through the pipe 29 to the injection valve 7 and accordingly to the engine is increased even if the plunger 24 is not moved. Likewise, if the operations of the actuator 10 are reversed, the fuel to be fed to the engine can be reduced. Incidentally, the motion of the plate 22 as a result of the increase in the intake air flow is slow, but the actuator 10 has a quick response because it is controlled by an electric signal coming from the engine control unit. Thus, the fuel can be controlled with excellent response.

Figure 4:
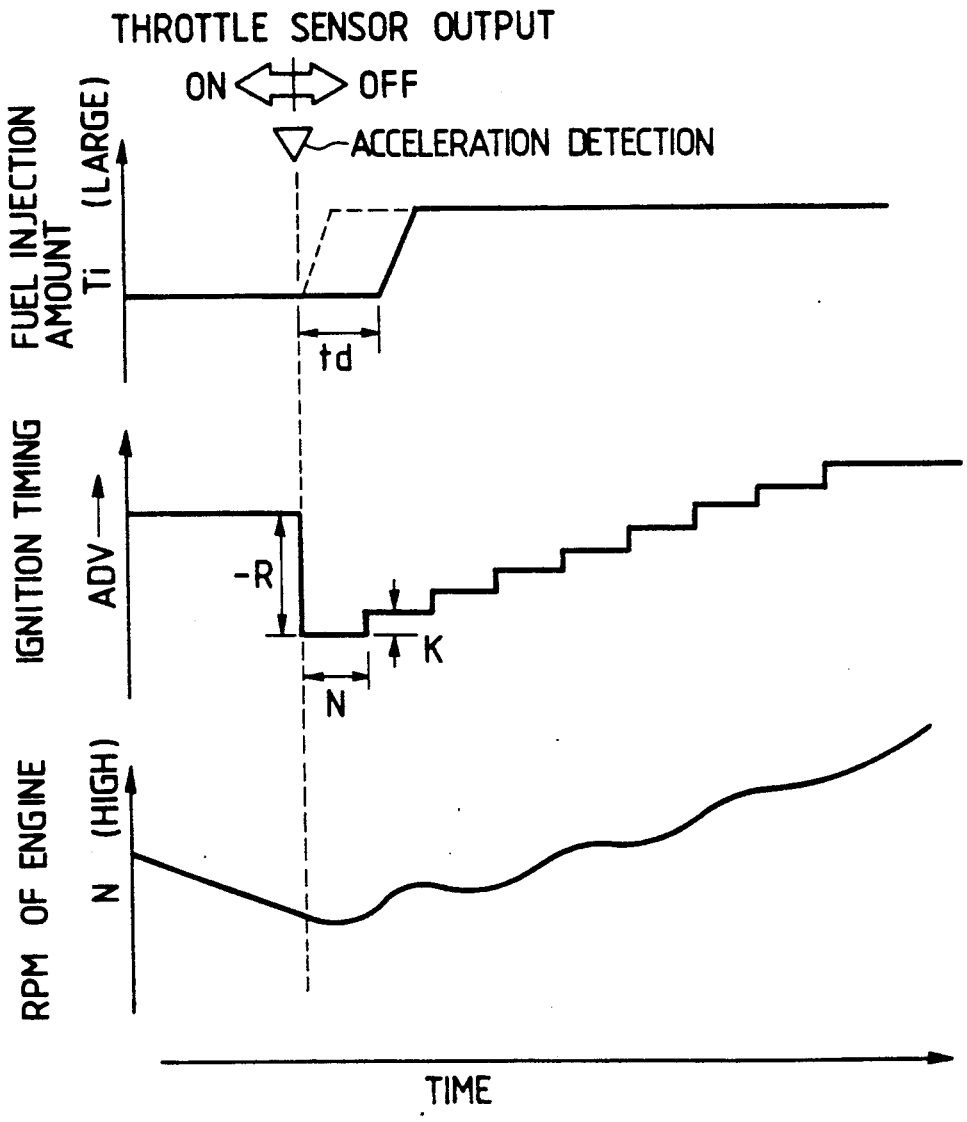
FIG. 4 is a diagram for explanation of an engine control of the prior art.

Next, a conventional method of fuel injection control and ignition timing control during acceleration will be described with reference to FIG. 4. When the throttle valve is opened to increase the intake air flow, the plate 22 is moved up to increase the fuel to be fed from the fuel distributor 15 to the injection valve 7 so that the fuel injection rate from the injection valve 7 is increased. Since the transmission system is mechanical, however, the fuel injection rate is not augmented immediately but with a time delay td after the throttle valve is opened, for example. As a result, for the time delay td after the throttle valve is opened, the intake air flow is increased, but the fuel injection rate is not increased. As a result, the air/fuel ratio is shifted to the lean side so that the torque necessary for the acceleration is not generated, causing a drop in the engine speed for a while. After lapse of the time delay td, on the other hand, the fuel injection rate is augmented to raise the torque abruptly. This operation is felt by the driver such that acceleration is not effected immediately after he depresses the accelerator, and thereafter acceleration shocks are felt and the engine speed is raised while hunting.

Generally speaking, moreover, the ignition timing is delayed for softening the acceleration shocks for the acceleration. For example, a predetermined amount of angle delay R is introduced when acceleration is detected, and an angle advance is then accomplished by K (degrees) for every N ignition cycles to restore the fundamental angle advance value. By this ignition timing control, however, the angle advance of the ignition timing is not sufficient, even after the timing has elapsed from the initial stage of the acceleration for shocks, so that the torque necessary for the acceleration cannot be achieved, as desired.

Figure 5:
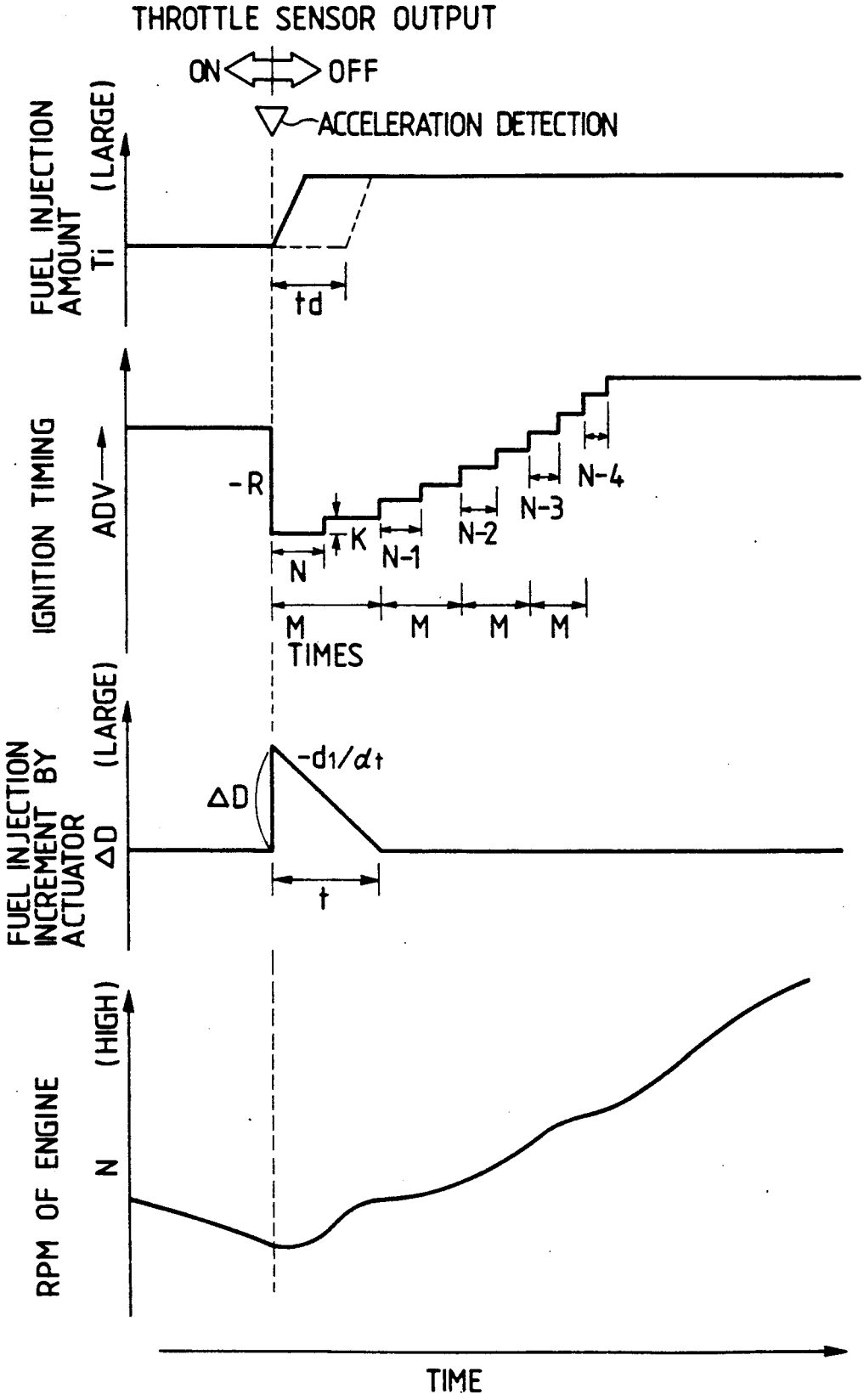
FIG. 5 is a diagram for explanation of an engine control system according to the present invention.

Next, the fundamental concept of the present invention will be described with reference to FIG. 5.

Now, it is assumed that the throttle valve is operated for acceleration. The intake air flow rate increases according to the operation of the throttle valve. However, as mentioned above, there is a time delay td from the instant when the increase in the intake air flow is detected by the plate 22 to the instant when the fuel injection rate is increased. If therefore, the acceleration is detected on the basis of the output of a sensor capable of detecting it fast, such as the throttle sensor 14, the output duty to the actuator 10 which is actuated by an electric pulse signal is increased quickly by ΔD to increase the injection fuel rate.

After this, the duty increment is reduced to zero when the fuel injection rate is increased by the plate 22. Since the control of the fuel injection rate by the actuator 10 has a quick response, as has been described hereinbefore, a sufficient fuel can be supplied when the highest torque is necessary for the acceleration. As is different from the afore-mentioned conventional control method, no torque drop due to the lean air/fuel ratio after the acceleration is produced, but the torque is smoothly raised when the throttle valve is opened. As a result, the acceleration shocks can be reduced together with the rotational fluctuations to prevent hunting.

Moreover, a predetermined retarding of the ignition angle is effected after the detection of acceleration so as to soften the acceleration shocks, and the angle advance for recovery is accelerated with time so as to ensure an effective increase in the torque after the acceleration. In other words, an angle advance of K (degrees) /N ignition cycles is accomplished M times. After this, the value of N is reduced to a predetermined value, for example N1, and the angle advance is accomplished M times. The operations are repeated to restore the fundamental angle advance value.

The specific operations of the present invention will be described with reference to FIGS. 6 to 8.

Figure 6:
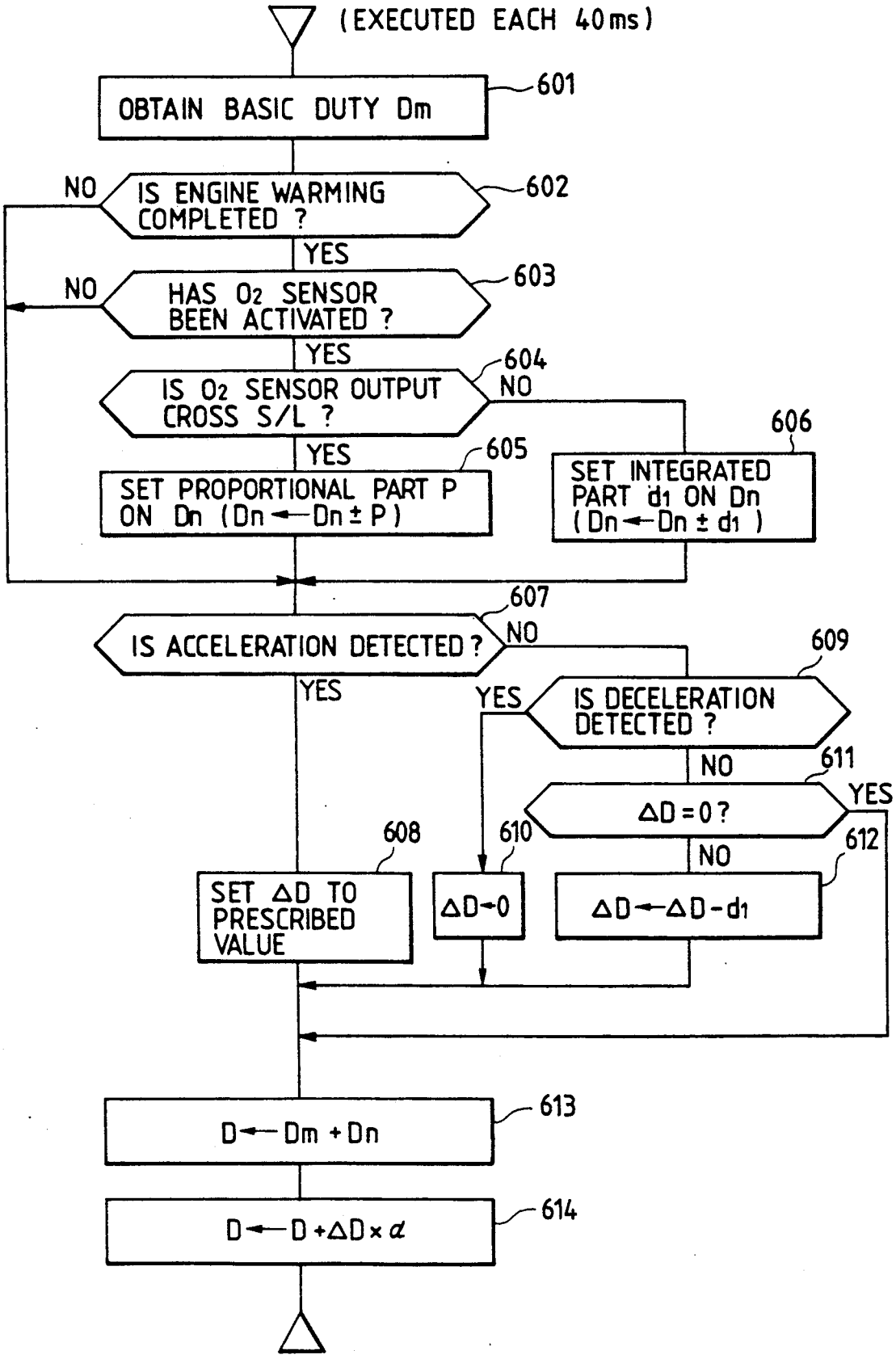
FIGS. 6 to 8 each are a flow chart of the engine control system according to the present invention.

FIG. 6 is a flow chart for calculating the duty for operating the actuator 10.

The duty comprises a basic or fundamental duty Dm, a feed back duty Dn and an acceleration fuel correction duty ΔD. At Step 601, the basic duty Dm is obtained from an output of a sensor indicating the engine state, e.g. a sensor for detecting intake vacuum indicating an engine load or a rotating state of the crankshaft. Steps 602 to 606 are used for determining the duty Dn for the $O_2$ feedback of the actuator 10. At the Step 602, it is decided whether or not the engine warm-up has ended. At the Step 603, it is decided whether or not the $O_2$ sensor has been activated. In case the warm-up is not ended and in case the $O_2$ sensor is not activated, the $O_2$ feedback is not accomplished, and the flow advances to Step 607. At the Step 604, it is decided whether or not the $O_2$ sensor output has crossed a threshold level S/L. In case the $O_2$ sensor output crosses the level S/L, a processing for effecting proportional control is accomplished at the Step 605 to compensate the control delay based on the $O_2$ sensor. In other words, a proportional component P is subtracted when the air/fuel ratio is changed from the lean to the rich side, and an proportional component P is added when the air/fuel ratio is changed from the rich to the lean side. If it is decided at the Step 604 that the S/L is not crossed, the integration is accomplished at the Step 606. In other words, an integral component I is added if lean before and subtracted if rich before.

The above Steps 601 to 606 are conventional.

Steps 607 to 612 are used to determine the duty DΔ for generating an acceleration fuel increment during acceleration. It is decided at the Step 607 whether or not an acceleration of the engine is detected. This acceleration can be detected depending upon whether or not the output of the throttle sensor is changed to a predetermined level or more, whether or not the idle switch is changed from ON to OFF, or how much the engine speed and load are changed. If acceleration is detected, the duty ΔD is set to a predetermined value, at the Step 608. If the acceleration is not detected at the Step 607, it is decided at the Step 609 whether or not deceleration is detected. In the case of deceleration, the fuel increment for the acceleration is not necessary any more, and the fuel injection may depend upon only the operation of the plate 22 so that the duty ΔD is set at zero at Step 610, If the deceleration is not decided at the Step 609, it is decided whether or not duty ΔD is zero. If the duty ΔD is zero, the procedure is advanced to the Step 613. If the duty ΔD is not zero, since it has elapsed after acceleration, the corrected value ΔD is reduced at a predetermined rate $d_1/dt$ while considering the fuel injection by the operation of the plate 22 at Step 642. Incidentally, if the value ΔD is smaller than zero, no more subtraction is accomplished on the assumption that the correction has ended.

At Step 613, the fundamental duty Dm and feedback duty Dn are added to provide the duty of the actuator 10. At Step 614, moreover, a new duty is determined by multiplying the duty ΔD for the acceleration fuel increment by a later described correction coefficient α and the result is added to the duty of the actuator determined at the Step 613. Incidentally, the correction coefficient α is based on the acceleration from the idle state.

The actuator 10 is opened according to the duty obtained here, whereby the fuel flow rate from the injection valve 7 to the engine cylinder is increased.

Figure 7:
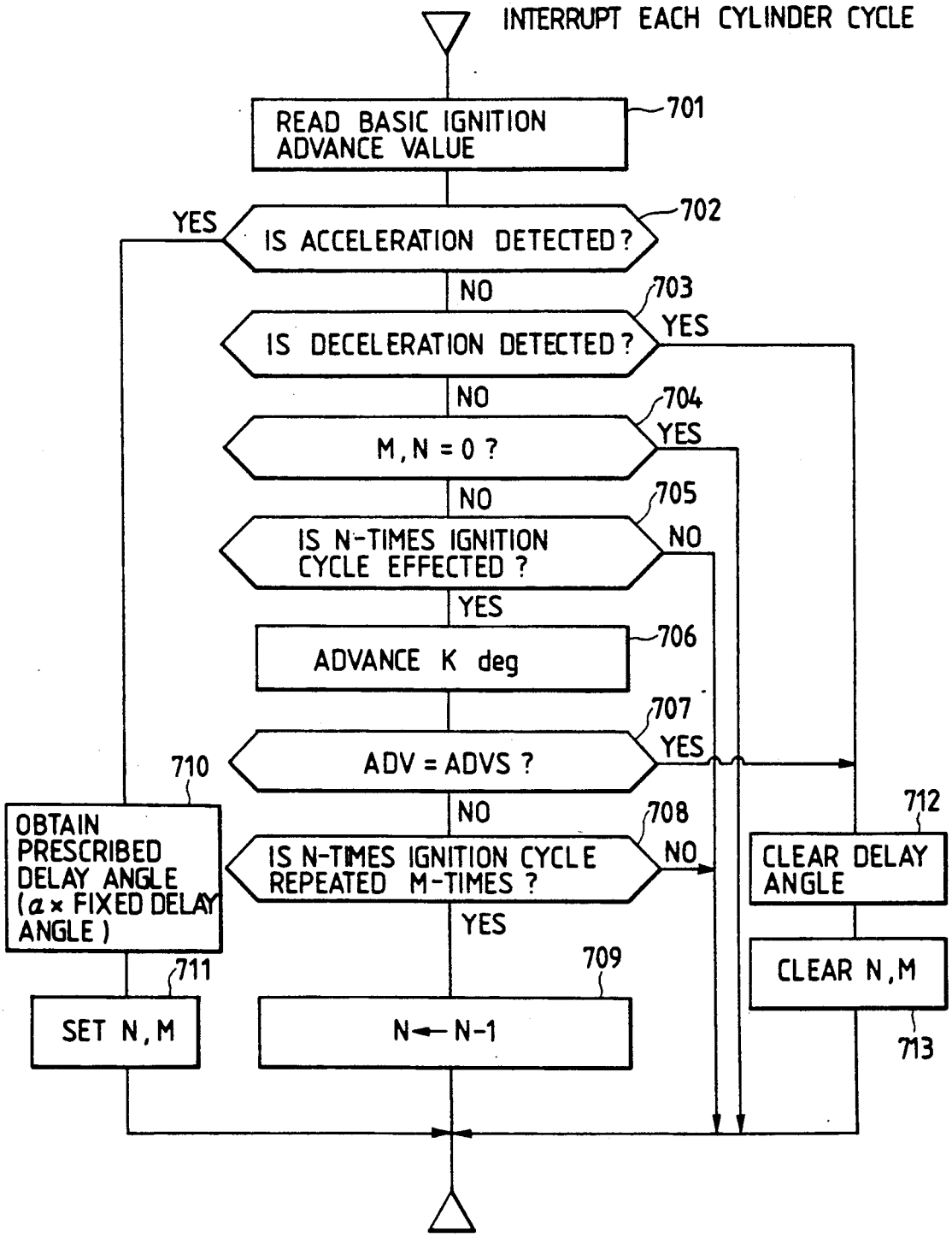

FIG. 7 is a flow chart for determining the ignition timing for the acceleration.

At Step 701, a fundamental ignition angle advance value is determined on the basis of the output of the sensor for determining the engine state and read in, which is effected in a conventional manner. At Step 702, it is decided whether or not an acceleration of the engine is detected. If the acceleration is detected, at Step 710, a predetermined angle delay as shown in FIG. 5 is accomplished to reduce the acceleration shocks. Incidentally, this predetermined value is obtained by multiplying a predetermined fixed value by the later described correction value α. At Step 711, there are set the predetermined value N for counting the ignition cycles and the predetermined value M for counting the latch times. In case the acceleration is not detected at the Step 702, it is decided at Step 703 whether or not a deceleration is detected. If NO, the processing for recovering the ignition timings after the acceleration are accomplished at and after the Steps 703. In case the deceleration is detected at the Step 703, there is not necessity for any processing. Then, the angle delay is cleared at Step 712 and set to the fundamental ignition angle advance, and the values N and M are cleared at Step 713, thus ending the flow. If at the Step 703 deceleration is not detected, it is decided whether or not the predetermined values N and M each are zero. If YES, the flow ends and if NO, at Step 704, it is decided whether or not the ignition cycles are latched by N times. If NOT, the flow is ended. If YES, at Step 706, the ignition timing is angularly advanced by K (deg). At Step 707, it is decided whether or not the ignition timing ADV is at a target ignition angle advance ADVS. If the ignition angle advance has reached the target value ADVS, the angle delay is cleared at Step 712, and the values M and N are cleared at Step 713, thus ending the flow. At Step 708, it is decided whether or not the latches of the ignition cycles of N times are further repeated by M times. If NOT, the flow is ended. If YES, the value N for counting the ignition cycles is subtracted by 1, and the flow is ended.

Figure 8:
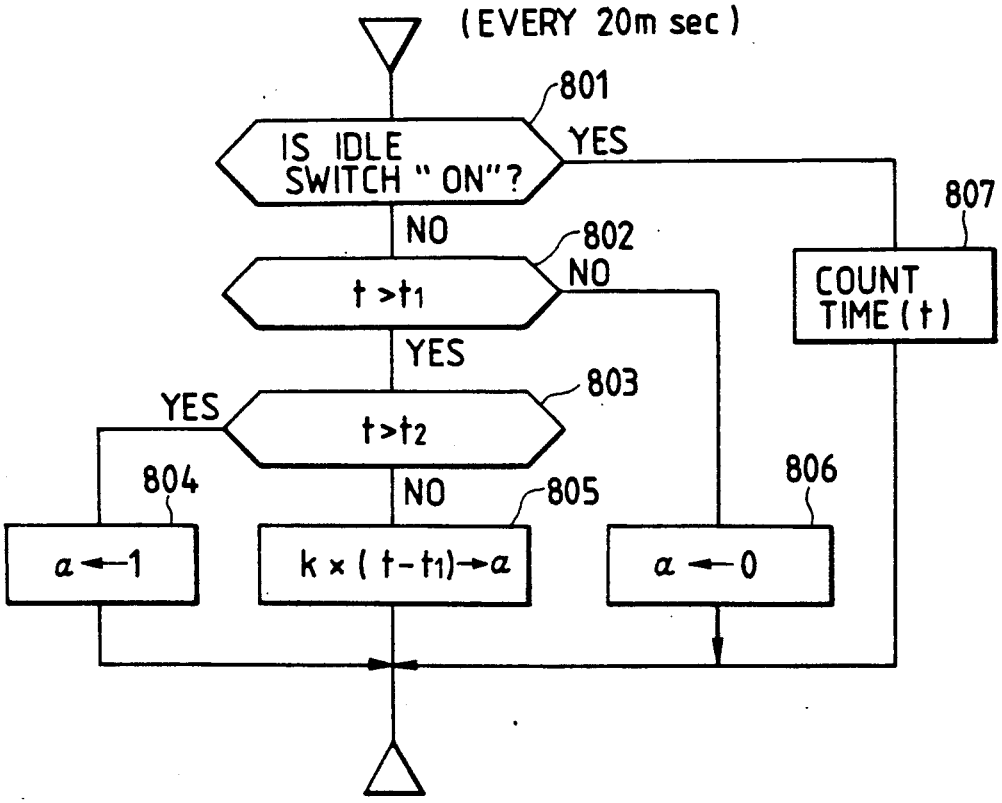

FIG. 8 is a flow chart for determining the aforementioned correction value α.

Generally speaking, the acceleration from the low speed range such as an idle run causes heavy shocks so that it requires correction. In case, however, the throttle valve is first returned and then opened again as in the gear changing operation, it is not so necessary to correct the fuel augmentation or the ignition timing. Moreover, the correction has to be proper even in case the accelerator pedal is slightly depressed from the idle operation.

At Step 801, it is decided whether or not the idle switch is ON. If ON, the counting of the timer t for checking the continuation of the idle state, is accomplished at Step 807. In the case it is OFF, the counted time t is compared with predetermined values $t_1$ and $t_2$ at Steps 802 and 803. In case the idle state continues longer than $t_1$, correction for the acceleration is necessary. If the idle state continues longer than $t_2$, the aforementioned correction coefficient α is set to 1 at Step 804. Incidentally, this value can be set at more than 1 by considering the acceleration from the idle state. In case, on the other hand, the idle state continues longer than $t_1$ but shorter than $t_2$, a correction according to the time t is accomplished at Step 805 so that the value α is set according to the following equation to establish a suitable driving feel:

$$\alpha = k33\,(t - t_1)$$

wherein k designates a correction coefficient. In case the time t is shorter than $t_1$, the driving operation involves a change of the gear, and the value α is set to zero at Step 806 so that no correction is accomplished. Incidentally, this correction coefficient α may take different values for the fuel control and the ignition advance, only one of which may be corrected according to the continuation of the idle state.

In the engine control system equipped with mechanical fuel injection control, according to the present invention, the fuel supply to the engine for the acceleration can be properly accomplished to raise effects that the drop of the torque during the acceleration can be prevented and that the acceleration shocks and the hunting can be suppressed.

What is claimed is:

1. An engine control system comprising a fuel injection valve for supplying fuel into the engine, a fuel distributor, including a plate disposed in an air intake passage so as to be movable in accordance with an intake air flow rate, for controlling a fuel supply rate from said fuel injection valve to an engine cylinder according to the movement of said plate, an actuator for controlling the fuel supply rate from said fuel distributor to said fuel control valve, acceleration detecting means for detecting acceleration of the engine, and means for operating said actuator so as to increase a fuel supply rate from said fuel distributor to said fuel injection valve and for delaying ignition timing by a predetermined angle immediately after detection of acceleration of the engine, and for thereafter gradually restoring the delayed ignition timing in a non-linear manner.

2. An engine control system according to claim 1, wherein said means generates an electric pulse signal to said actuator and said actuator is controlled by changing a pulse duty thereof.

3. An engine control system according to claim 1, wherein a restoration rate of said delayed ignition timing is increased with lapsed time.

4. A method of controlling an internal combustion engine, wherein fuel is injected into the engine by mechanically controlling a fuel injection amount in response to a suction air flow, and wherein acceleration shock is reduced by incrementing said fuel injection amount by a fuel incrementation amount for acceleration at a time of detection of the acceleration, with an ignition timing being delayed for a certain time, when the acceleration takes place from an idle state in which a throttle valve is fully closed, said method comprising the steps of:

detecting a duration of time during which the engine operates in the idle state prior to acceleration; and correcting said fuel incrementation amount for the acceleration according to the detected duration of time during which the engine operates in the idle state prior to acceleration, said fuel incrementation amount being increased in a stepwise manner at the time of detection of acceleration immediately following said duration of time in which the engine is in the idle state and being decreased gradually thereafter.

5. The method according to claim 4, wherein a correction amount of the fuel incrementation amount for acceleration is larger as said duration of time of the engine in the idle state is longer.

6. The method according to claim 4, wherein said delayed ignition timing is restored by effecting angle advance at an angle advance rate that is larger as time lapses.

7. The method according to claim 6, wherein said angle advance is effected at a rate of K degrees for every N ignition cycles.

8. A method of controlling an internal combustion engine provided with a mechanical fuel injection control apparatus, comprising the steps of: controlling a fuel injection amount in response to the movement of a plate disposed in a suction air flow channel, reducing acceleration shock by increasing the fuel injection amount by an incremented amount for acceleration while retarding ignition timing at a time of detection of acceleration taking place from an idle state in which a throttle valve is fully closed, detecting a duration of time during which the engine operates in the idle state prior to acceleration, and correcting said incremented amount for the acceleration according to the length of said duration of time during which the engine operates in the idle state prior to acceleration.

9. The method according to claim 8, wherein the injected fuel amount is increased by the incremented amount for acceleration in a stepwise manner at the time of detection of the acceleration and the fuel incrementation amount is reduced gradually to zero thereafter until the fuel amount for acceleration is controlled in response to the movement of the plate of the mechanical fuel control apparatus.

10. The method according to claim 8, wherein said delayed ignition timing is restored by effecting angle advance at an angle advance rate that becomes larger as time lapses.

11. The method according to claim 10, wherein said angle advance is effected at a rate of K degrees for every N ignition cycle.

* * * * *